US005893314A

United States Patent [19]

Kapolnek et al.

[11] Patent Number: 5,893,314

[45] Date of Patent: Apr. 13, 1999

[54] KNIFE ASSEMBLY FOR ROTARY CUTTING SYSTEM

[75] Inventors: Paul G. Kapolnek, Chicago; Charles H. Bridges, Kildeer, both of Ill.

[73] Assignee: Western Printing Machinery Company

[21] Appl. No.: 08/963,383

[22] Filed: Nov. 3, 1997

Related U.S. Application Data

[63] Continuation of application No. 08/630,465, Apr. 10, 1996, abandoned.

[51] Int. Cl.[6] ..... B26B 7/26

[52] U.S. Cl. ..... 83/698.41; 83/698.42; 83/698.61; 83/699.61

[58] Field of Search ..... 83/698.41, 698.42, 83/698.51, 698.61, 699.51, 699.61, 677, 678, 673, 954

[56] References Cited

U.S. PATENT DOCUMENTS

| | | | |
|---|---|---|---|
| 2,034,161 | 3/1936 | Theil | 83/698.51 X |
| 3,106,121 | 10/1963 | Novick | 83/346 X |
| 3,128,663 | 4/1964 | Dovey | 83/346 X |
| 3,555,948 | 1/1971 | Olson | 83/346 X |
| 3,703,117 | 11/1972 | Matthews | 83/698.61 X |
| 3,752,042 | 8/1973 | Castille | 83/698.51 X |
| 3,779,123 | 12/1973 | Chafee | 83/698.41 X |
| 3,857,314 | 12/1974 | Gregoire . | |
| 3,893,359 | 7/1975 | Gregoire | 83/154 |
| 3,954,050 | 5/1976 | Grobman | 83/504 X |
| 4,020,724 | 5/1977 | Quinlan . | |
| 4,073,485 | 2/1978 | Gregoire et al. | 493/353 |
| 4,113,243 | 9/1978 | Gregoire et al. | 493/432 X |
| 4,295,400 | 10/1981 | Larson | 83/545 |
| 4,335,316 | 6/1982 | Glanz et al. | 250/572 |
| 4,335,634 | 6/1982 | Larson | 83/545 X |
| 4,338,087 | 7/1982 | Gregoire | 493/425 |
| 4,409,870 | 10/1983 | Rynik et al. | 83/100 |
| 4,412,467 | 11/1983 | DeSanto | 83/698.41 X |
| 4,421,501 | 12/1983 | Scheffer | 493/439 |
| 4,463,640 | 8/1984 | Cogswell et al. | 83/701 X |
| 4,475,425 | 10/1984 | Punater et al. | 83/698.51 X |
| 4,640,165 | 2/1987 | McMahon et al. | 83/698.51 X |
| 4,700,481 | 10/1987 | Barrett | 83/698.61 X |
| 4,799,414 | 1/1989 | Scheffer et al. | 83/346 X |
| 4,846,030 | 7/1989 | McMahon et al. | 83/27 |
| 4,854,204 | 8/1989 | Faltin | 83/698.41 X |
| 4,896,573 | 1/1990 | Kapolnek | 83/347 X |
| 4,920,843 | 5/1990 | Stromberg et al. | 83/346 |
| 4,962,683 | 10/1990 | Scheffer et al. | 83/698.41 X |
| 5,007,890 | 4/1991 | Alverth et al. | 493/434 |
| 5,088,975 | 2/1992 | Ghilardi | 493/359 |
| 5,146,831 | 9/1992 | Fetter, Jr. et al. | 83/698.41 |
| 5,193,425 | 3/1993 | Campbell, Jr. et al. | 83/113 |
| 5,271,442 | 12/1993 | Carpenter et al. | 83/698.41 X |
| 5,282,409 | 2/1994 | Rojas | 83/698.51 X |
| 5,334,129 | 8/1994 | Haller | 493/351 |

FOREIGN PATENT DOCUMENTS

| | | |
|---|---|---|
| 35 11 580 A1 | 10/1986 | Germany . |
| 1048301 | 11/1966 | United Kingdom . |

*Primary Examiner*—M. Rachuba

*Attorney, Agent, or Firm*—Brinks Hofer Gilson & Lione

[57] ABSTRACT

A knife holder assembly for a rotary cutting machine includes a holder with a top portion and side portion each including an opening, and an adjusting member with a body portion and an extender. The extender is adapted to extend through the side portion opening and has a backing portion at its end. The body portion has an indention with a tapered sidewall for allowing a fastener to be inserted through the top portion opening and contact the tapered sidewall thereby moving the adjusting member in a direction away from the side portion to clamp an inserted knife between the backing portion and the side portion.

27 Claims, 6 Drawing Sheets

KNIFE ASSEMBLY FOR ROTARY CUTTING SYSTEM

This application is continuation of Ser. No. 08/630,465, filed Apr. 10, 1996, now abandoned.

BACKGROUND OF THE INVENTION

The invention relates generally to rotary cutters for cutting web or sheet material, and more particularly to a knife holder apparatus which may be attached to a knife cylinder and employed with an associated anvil cylinder to transversely cut or score a moving web or sheet.

It is conventional practice to use a rotary cutter to transversely cut web material received from a printing press. In general, rotary cutters have an anvil cylinder and a knife cylinder which are rotatable in timed relation. One or more knife holders, which hold the cutting knives are attached to the knife cylinder. The knife and anvil cylinders normally rotate at the same speed and the moving paper or web material is transversely cut or scored as the cutting knife moves into and out of engagement with the anvil surface. The cutting knives may be spaced apart to create the desired cut.

In the conventional rotary cutter, knife replacement is a time-consuming operation. Reducing this replacement operation has become even more important with the increased use of recycled paper and its negative effect on the life of the cutting knife. To reduce down time due to blade replacement, unitary epoxy knife holder and blade assemblies 112, for example, as shown in FIG. 14 have been employed. Replacement of a worn cutting knife, however, requires that the entire assembly be removed from the knife cylinder, which requires stripping away the cushioning and rubber material which is placed over the knife cylinder and portions of the holder. The installer must then realign and remount the replacement holder on the knife cylinder. This problem is partially avoided by use of a knife holder assembly as shown in FIG. 15. This knife holder assembly includes a metal holder 116 and a backing member 110, which locks a cutting rule 114 to the holder 116 with holding screws 118. Although this knife holder assembly does not require the complete removal of the holder 116 from the knife cylinder, it does require some of the cushioning material to be stripped back because the release screws 118 are located on the side of the holder. This requires the person changing the cutting rule 114 to loosen the holding screws 118 from the side of the holder, which is both awkward and time consuming.

It would be desirable to have a knife holder assembly that would allow the user to quickly and efficiently remove the worn cutting knife and replace it without removing the holder from the knife cylinder. It would further be desirable to provide a knife holder assembly that would aid in relieving some of the wear on the knife blade.

SUMMARY OF THE INVENTION

The invention provides a knife holder apparatus and method of operating the same. The knife holder apparatus includes a holder, and an adjusting member. The holder includes an opening through its top portion and an opening through its side portion. The adjusting member includes an extender adapted to extend through the side portion opening. The extender includes a backing portion at its outer end. The adjusting member also includes a body portion which includes an indention with a tapered sidewall to allow a fastener to be inserted through the top portion opening and contact the tapered sidewall thereby moving the backing portion toward the side portion to clamp an inserted knife between the backing portion and an outer side of the side portion, and to allow a fastener to be retracted to allow the backing portion to be moved away from the side portion to release the knife.

This design allows the operator to replace the knife by simply loosening or removing the fastener or fasteners from the top portion of the holder. This eliminates the need to pull back or remove the cushioning material to get at side mounted fasteners or screws and thereby reduces downtime.

The invention further provides other features which include the following: a slot formed through the top portion for allowing the holder to be fastened to a knife cylinder; the extender being a separate peg member attached at one end to the body portion, and at its other end to the backing portion; the peg member being screwably attached to the body portion; the above apparatus further including a knife for inserting between the backing member and the side portion; the above apparatus further including a fastener for inserting through the top portion opening and contacting with the tapered sidewall; the fastener being a set screw and the top portion opening having threaded sidewalls for receiving the screw; the backing portion being a separate member movably attached to the extender; the backing member having an opening formed therethrough for allowing the extender to slidably fit through the backing member opening, and the extender having a cap portion for retaining the backing member on the extender; the body portion indention being an opening having a tapered sidewall; and a holder with a second side portion including an opening for allowing the adjusting member to slidably extend therethrough.

The invention further provides that the top portion includes a second opening which is positioned further than the first top portion opening from the side portion. The second top portion opening is in communication with a second indention with tapered sidewall formed on the body portion for allowing two knives and a spacer to be inserted between the side portion and the backing portion and clamped therebetween when a fastener is inserted through the second opening. The top portion may also include a first series of openings communicating with a series of adjusting members aligned so that each indention aligns with one of the first series of openings. The top portion may also include a second series of openings which are positioned further than said first series from the side portion and aligned with the second indention of one of the adjusting members. The first series of top portion openings may comprise four spaced openings, each of which being aligned with the first indention of one of four adjusting members. The second series of top portion openings may comprise four spaced openings, each of which aligned with the second indention of one of the four adjusting members. Each of the indentions may comprise an opening formed in the body portion of the adjusting member and have tapered sidewalls for allowing contact with a fastener inserted through the top portion openings.

The invention further provides for a resilient strip, for example, a urethane strip adapted to be positioned adjacent a knife and clamped between the backing member and side portion of the holder. The urethane has been shown to increase the blade life.

The features of the invention are aimed at providing a knife holder assembly that is both easy to manufacture and easy to maintain. The adjusting member and the holder openings are designed to allow one knife or two knives to be easily inserted and removed from the holder assembly. By use of the additional knife and spacer, or by positioning two separate holders back to back on the knife cylinder, any desired distance between the knives can be achieved.

The invention further provides for a method of operating a knife holder. A knife or cutting rule is inserted between a side portion of a holder and a backing portion of an adjusting member. A fastener is then inserted through an opening formed in a top portion of the holder to contact with a tapered sidewall formed in the adjusting member. This contact moves the adjusting member in a direction away from the side portion The knife is thereby clamped between the side portion and the backing portion. Alternatively, prior to inserting or tightening the fastener, a urethane strip may be inserted on both sides of said knife. A spacer and a second knife may also be inserted adjacent the first knife. And, again, a urethane strip may be inserted on both sides of each knife.

These and other features and advantages of the present invention will become apparent to those skilled in the art upon review of the following detailed description of the presently preferred embodiments of the invention taken in conjunction with the accompanying drawings.

DETAILED DESCRIPTION OF THE PRESENTLY PREFERRED EMBODIMENTS

Figure 1:
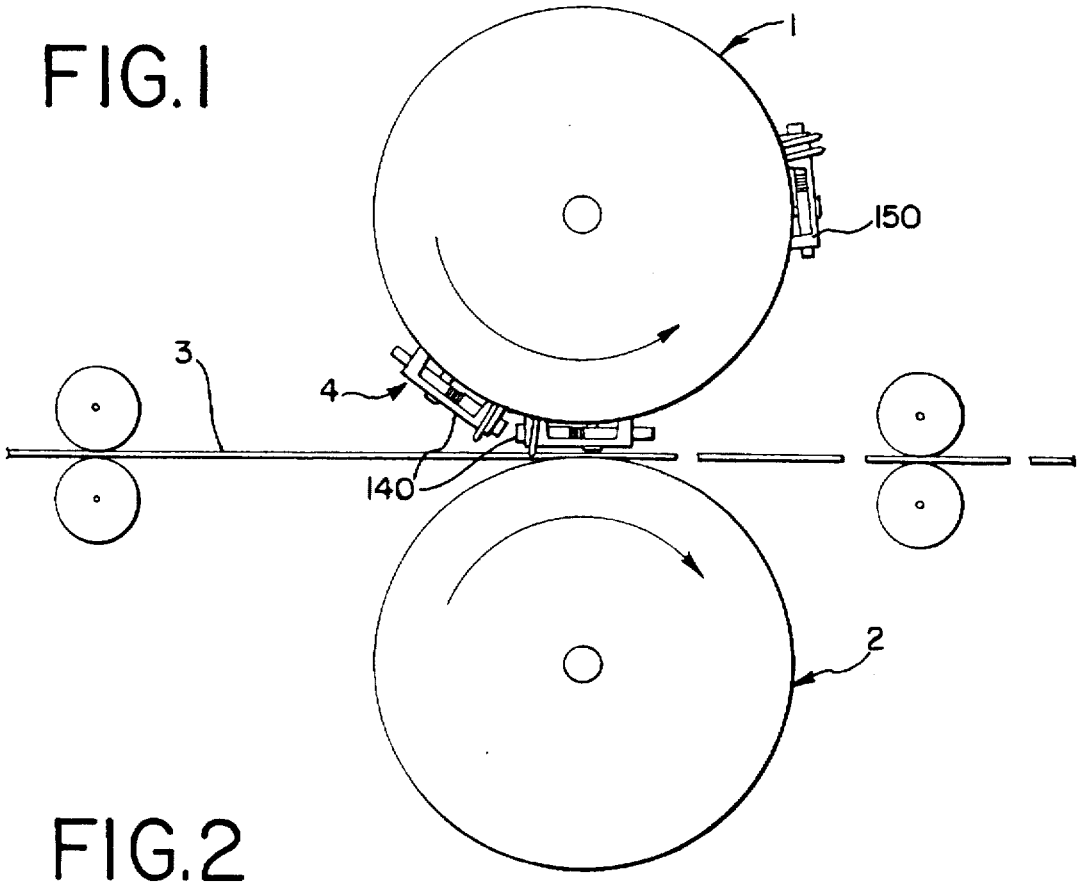
FIG. 1 is a schematic view of a rotary cutter with knife holders mounted on the knife cylinder.
Figure 2:
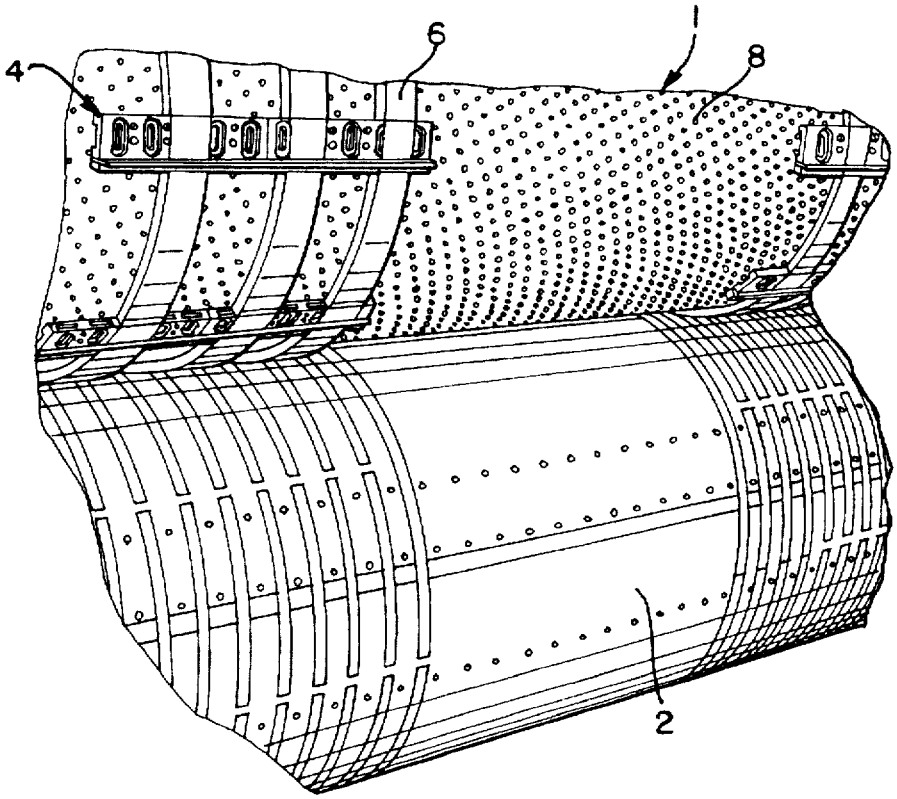
FIG. 2 is a perspective view of a rotary cutter showing embodiments of the knife holders mounted on the knife cylinder.
Figure 3:
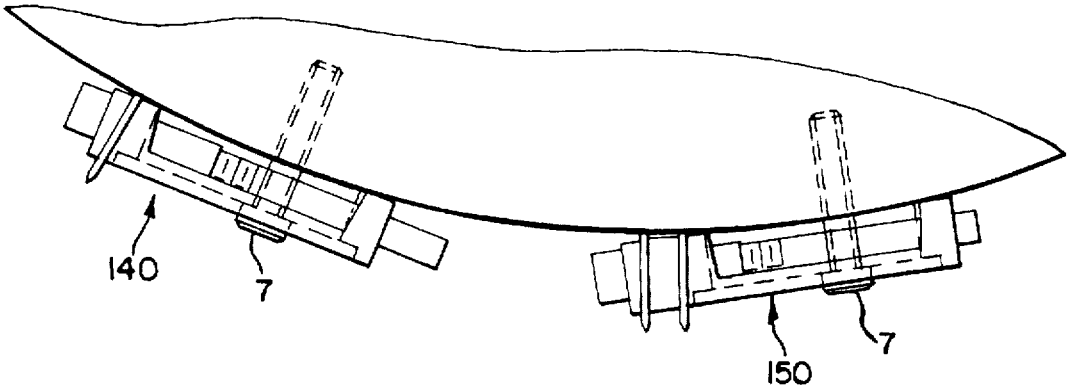
FIG. 3 is a sectional view of embodiments of the knife holders mounted on the knife cylinder.

Referring to FIG. 1, there is shown a schematic diagram of a rotary cutter having a knife cylinder 1, and anvil cylinder 2. The web material 3 is shown passing between the nip formed between the two cylinders. A single knife embodiment 140 of the knife holder assembly 4 and a double knife embodiment 150 are shown attached to the knife cylinder 1. FIG. 2, further shows a single knife embodiment 140 mounted on the knife cylinder 1. The knife holder assembly 4 is preferably sized for use on a discrete section of the knife cylinder. Alternatively, the knife holder may be sized to cover greater portions of the knife cylinder 1, and numerous individual knife holders may be mounted on the knife cylinder. The rubber cushioning 6 is also shown which facilitates the driving of the web through the cylinders and acts to keep the web taut while it is cut. The knife cylinder has a plurality of receiving holes 8, which are preferably threaded holes, positioned in a uniform matrix or array about its outer surface. FIG. 3 shows single-knife embodiment 140 and double-knife embodiment 150 of the knife holder mounted on the knife cylinder 1. A long screw 7 (shown partially in phantom) is screwed into one of the threaded holes 8 to secure the holder to the knife cylinder 1.

Figure 4:
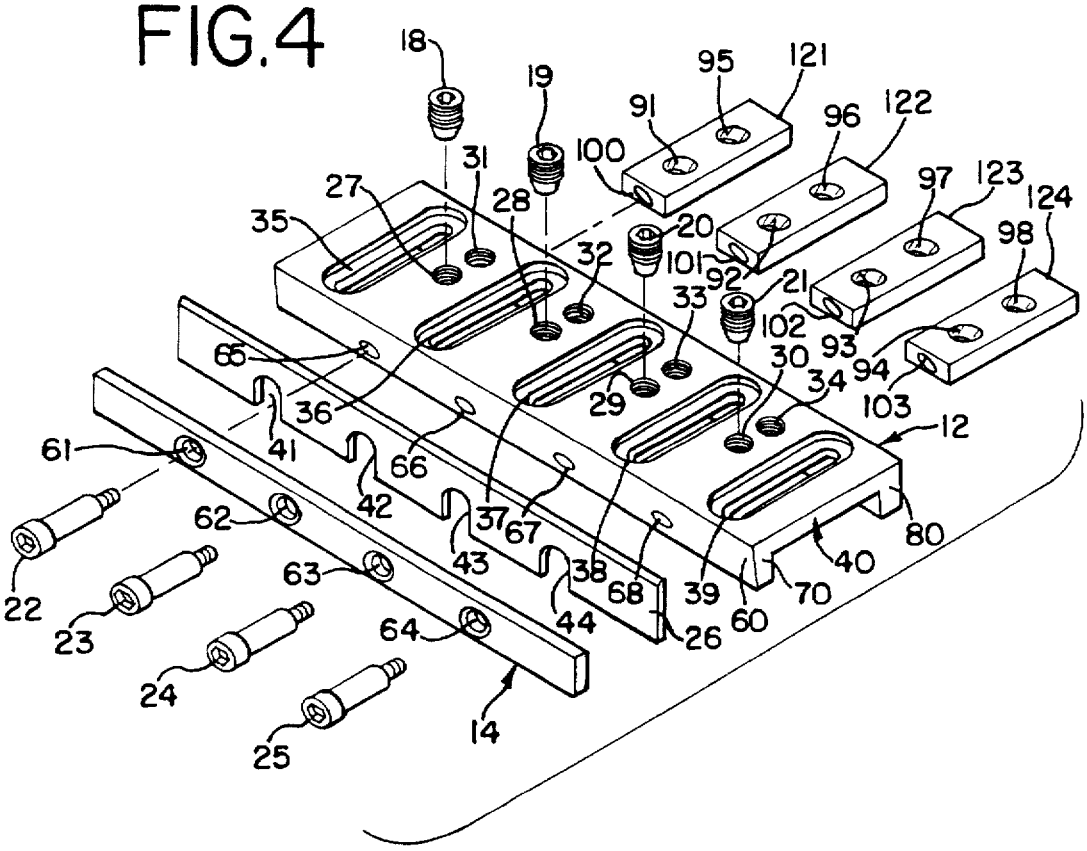
FIG. 4 is an exploded perspective view of a single knife embodiment of the invention.
Figure 5:
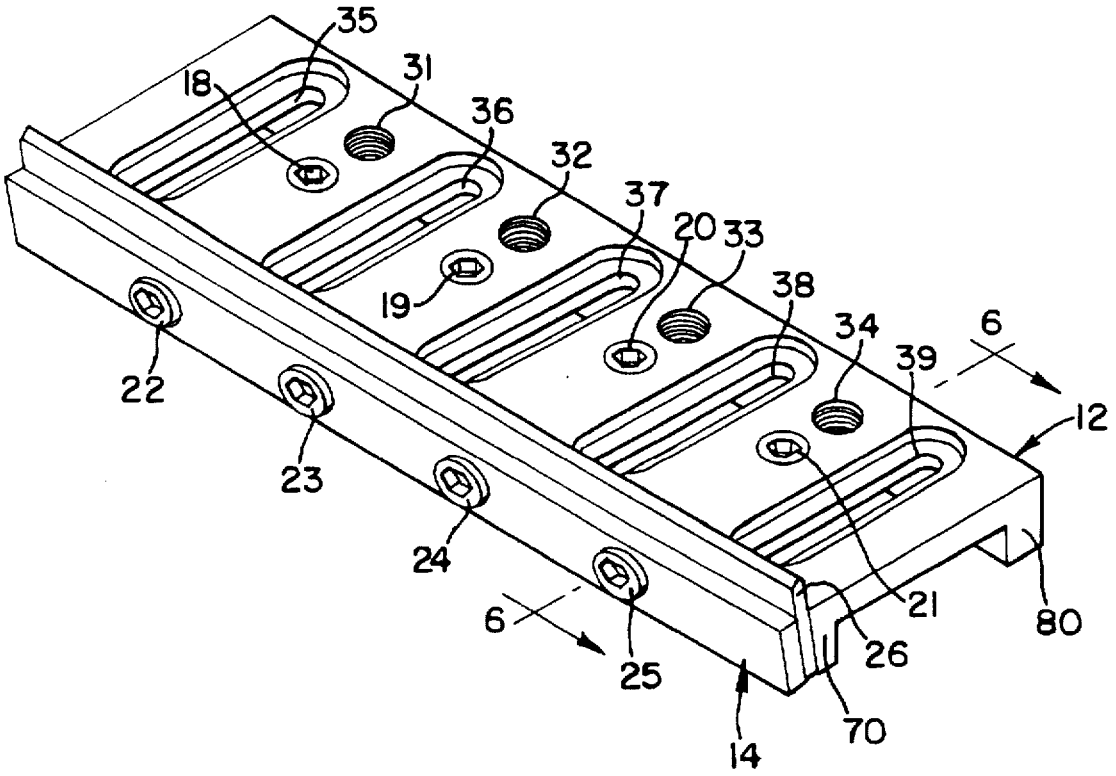
FIG. 5 is a perspective view of the embodiment of FIG. 4 in the closed position.

Referring to FIGS. 4 and 5, an exploded perspective view, and a closed view of the single-knife embodiment 140, respectively, is shown. The knife holder assembly includes a holder 12, backing bar 14, adjusting bars 121–124, locking screws 18–21, peg members 22–25, and cutting rule or knife 26. The holder 12 is preferably made of a 7/16×1¾ inch steel channel member having a 5.570 inch length. The holder has a first set 27–30 and a second set 31–34 of four openings bored through its top portion 40. These openings are preferably 5/16 diameter threaded screw holes to receive the locking screws 18–21, which are preferably 5/16–24×⅜ LG. set screws. The screws 18–21 are designed to be interchangeable in any of the openings in the first or second set of openings. The top portion 40 of the holder 12 also has attachment slots 35–39 for allowing the holder 12 to be positioned upon or fastened to a knife cylinder 1, as shown in FIG. 3.

Figure 8:
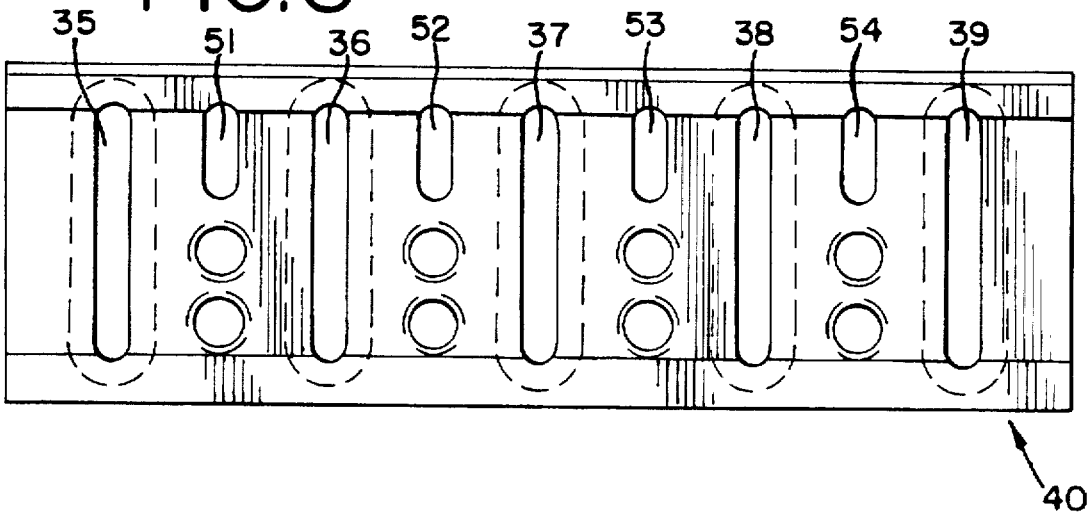
FIG. 8 is a bottom view of the holder embodiment.

Referring to FIG. 8, a bottom view of the top portion 40 of the holder 12 is shown. The slots 35–39 preferably have an inner opening with a 0.187 inch width and an outer opening with a 0.436 inch width. The slot-shaped indentions 51–54 which are aligned with the first and second set of openings are preferably 3/16 diameter and 0.040 inches deep and allow the shaft portion 74 of the peg members 22–25 to slide more easily.

Figure 7:
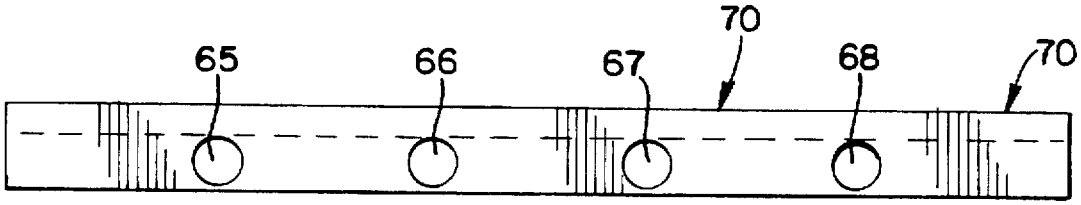
FIG. 7 is a side view of a first side portion of the holder embodiment.

Referring to FIG. 7 a side view of the first side portion 70 is shown. The first side portion 70 has a length of preferably the same as the length of the holder 12 of 5.570 and a width of 0.437 inches. The first side portion openings 65–68 are centered at 0.287 inches from the top edge of the first side portion 65–68 and are spaced 1.1147 inches from their centers.

Figure 6:
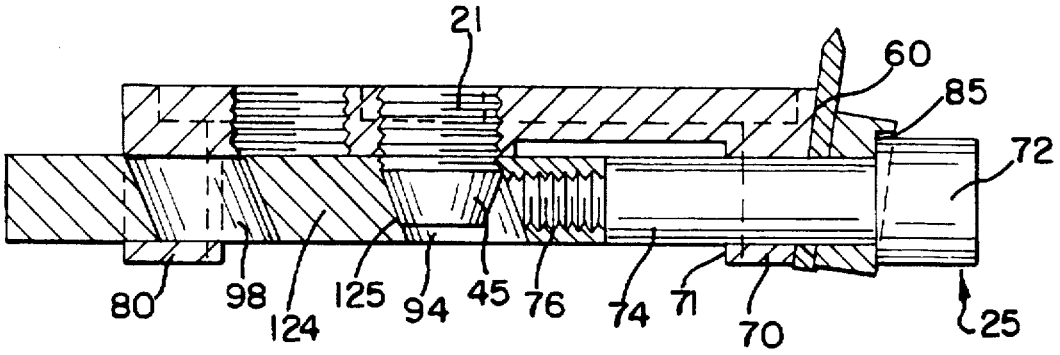
FIG. 6 is a sectional view of the knife holder assembly taken through line 6—6 of FIG. 5.

Referring to FIGS. 4 and 6, the first side portion has an outer face 60 which is preferably angled 7° degrees from the vertical to position the knife 26 for optimum cutting on knife cylinders with diameters ranging between 24 and 50 inches. The backing bar 14, shown in FIG. 4, preferably has a length of 5.570 inches, a width of 0.375 inches and a depth of 0.125 inch. The openings 61–64 are aligned with the first side portion openings 65–68. As shown in FIG. 6, the backing bar openings 61–64 have recessed area 85 surrounding the openings, and both the opening and recessed area are angled at 7° degrees to allow the backing bar 14 to uniformly hold the knife 26 to the angled face 60 of the first side portion 70. The peg member 25 has a cap portion 72, a shaft portion 74 and screw portion 76. The cap portion 72 fits in the recessed area 85 around the backing bar member openings 61–64. The shaft portion 74 fits through these openings 61–64. The knife 26 has notches 41–44 which maintain the 7° degree alignment of the knife with the outer face 60 of the first side portion 70.

Figure 9:
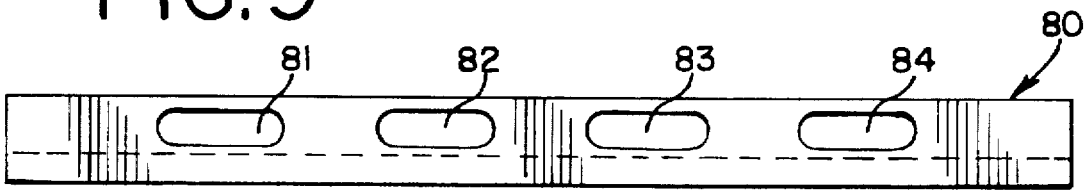
FIG. 9 is a side view of a second side portion of the holder embodiment.

Referring to FIG. 9, the second side portion 80 of the holder 12 preferably has a length of 5.570 inches, a width of 0.437 inches and has slots 81–84 bored through its 0.25 inch thickness. The slots 81–84 are positioned to allow the adjusting bars 121–124 to slide through. As shown in FIG. 4, the adjusting bars 121–124 preferably have a length of 1.5 inches, a width of 0.50 inch and a thickness of 0.187 inch. Preferably, the adjusting bars 121–124 extend at least partially through the second side portion openings 81–84. These second side portion openings are positioned to maintain perpendicular alignment with the inner sidewall 71 of the first side portion 70. The top of the first set of adjusting bar openings 91–94 preferably have 5/16 inch diameters and generally align with the first set of top portion openings 27–30 when the knife holder assembly is in the closed position as shown in FIG. 5. Similarly, the second set of adjusting bar openings 95–98 align with the second set of top portion openings 31–34. As shown in the sectional view of FIG. 6, both the first set 91–94 and second set 95–98 of adjusting bar openings are bored at an angle of 21° degrees from the vertical. This angle is designed to receive the tapered end portions 45 of the set screws 18–21 which are also angled at 21° degrees from the vertical. The adjusting bars 121–124 also have screw holes 100–103 that are designed to receive the screw portion 76 of the peg members 22–25.

Figure 10:
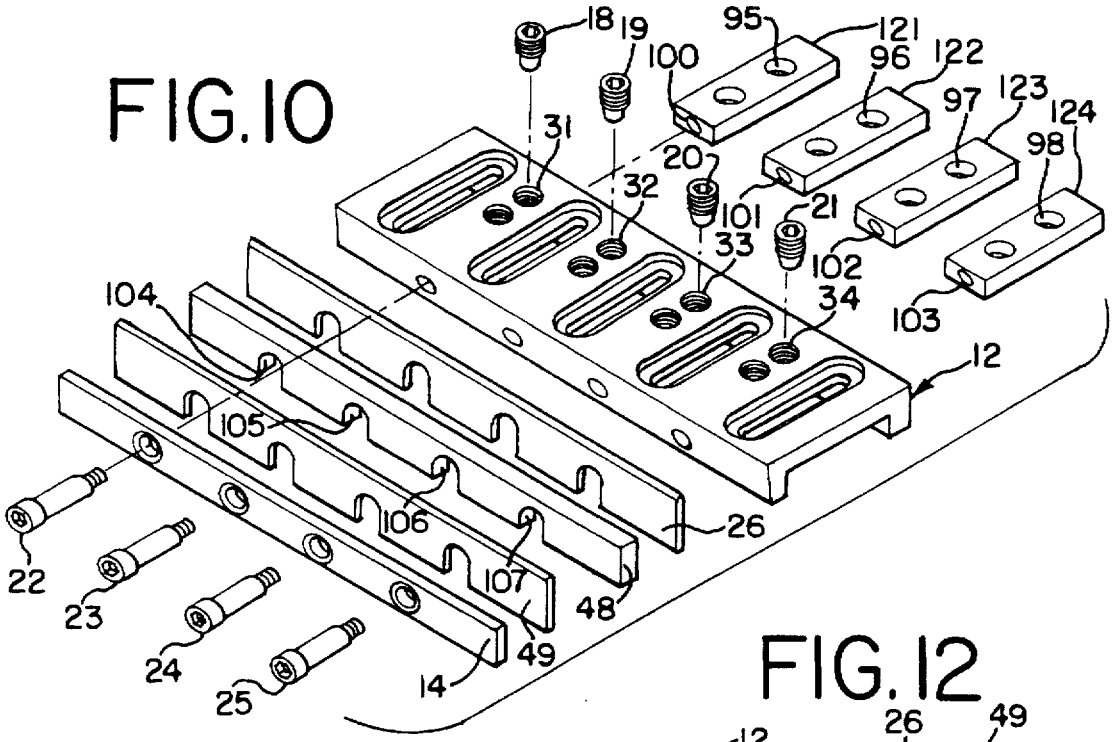
FIG. 10 is an exploded perspective view of a double knife embodiment of the invention.
Figure 12:
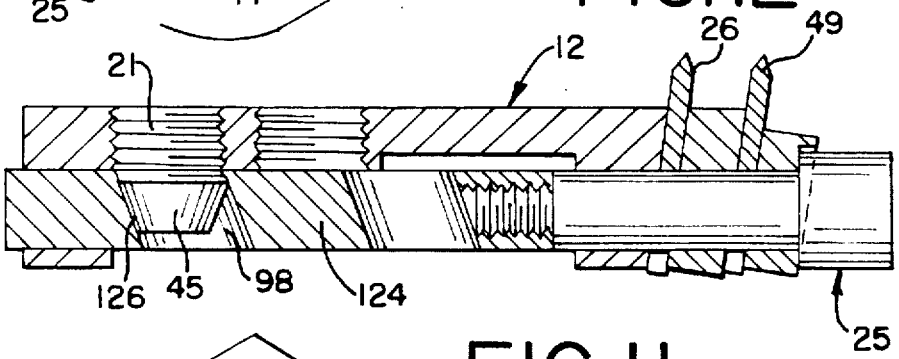
FIG. 12 is a sectional view of the knife holder assembly taken through line 12—12 of FIG. 11.
Figure 11:
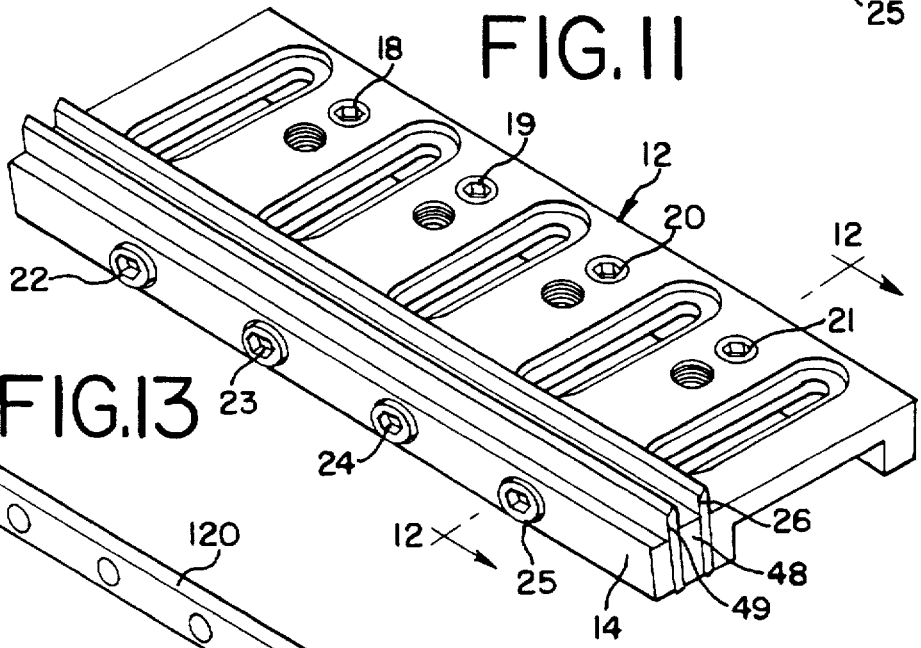
FIG. 11 is a perspective view of the embodiment of FIG. 10 in the closed position.

Referring to FIGS. 10–12, a double knife preferred enbodiment is shown. A spacer 48 is inserted between the first knife 26 and a second knife 49. The spacer 48 preferably has a length of 5.573 inch, a width of 0.437 inch and a thickness that may be varied to achieve a desired distance between the knives. The notched openings 104–107 are angled at 7° degrees to the horizontal to allow the spaced knives 26, 49 to be uniformly clamped between the backing bar 14 and the first side portion 70. In this embodiment, the set screws 18–21 are screwed into the second set of top portion openings 31–34 as shown in FIGS. 11 and 12.

When the rotary cutting machine is shut down for maintenance, the operator would preferably use a hex wrench to loosen or remove the set screws 18–21 from, for example, the first set of openings 27–30, as shown in FIGS. 4–6. This, in turn, causes the tapered portion 45 of the set screw to come out of contact with the tapered sidewall 125 of the first set of adjusting bar openings 91–94, thus allowing the adjusting bars 121–124 with attached peg screws 22–25 to translate or move toward the first side portion 70 which loosens the clamped knife 26. The operator may then replace the worn knife 26 with a new knife by aligning the notches 41–44 of the knife with the shaft portion 74 of the pegs 22–25 and setting the knife onto the shaft 74 of each of the pegs. The operator may then easily and rapidly tighten the set screws 18–21 using the hex wrench which drives the tapered angled screw portion 45 against the tapered sidewall 125 of the first set of adjusting bar openings 91–94. This moves the adjusting bars 121–124 and attached pegs 22–25 toward the second side portion 80. The cap portion 72 of the 22–25 pegs retains the backing bar against the knife and clamps it to the outer face 60 of the first side portion 70. The rotary cutting operation can then be resumed.

Alternatively, as shown in the embodiment of FIGS. 10–12, the operator may place a spacer 48 and a second knife 49 onto the shaft portion 74 of the pegs 22–25. The set screws 18–21 would then be screwed into the second set of top portion openings 31–34. The tapered end 45 of the set screws 18–21 contacts with tapered sidewall 126 of the second set of adjusting bar openings 95–98, thus moving the adjusting bars 121–124 and attached pegs 22–25 toward the second side portion 80. The adjusting bars 121–124 extend partially through the second side portion openings 81–84. The spacer 48 may have a desired thickness to achieve the desired cut. In addition, the angle of outer face 20 of the first side portion 70 may be altered for different diameter knife cylinders. The embodiments described herein may be used for a 24–50 inch diameter knife cylinder.

Figure 13:
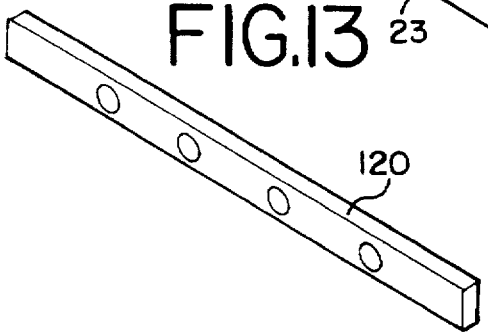
FIG. 13 is a perspective view of an urethane strip for placing on the sides of the knife.
Figure 14:
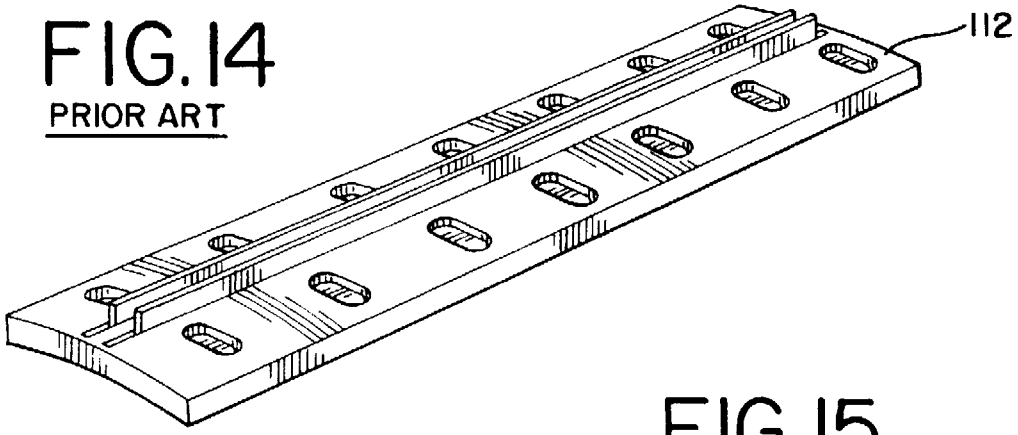
FIG. 14 PRIOR ART
FIG. 14 is a perspective view of an existing epoxy knife holder assembly.
Figure 15:
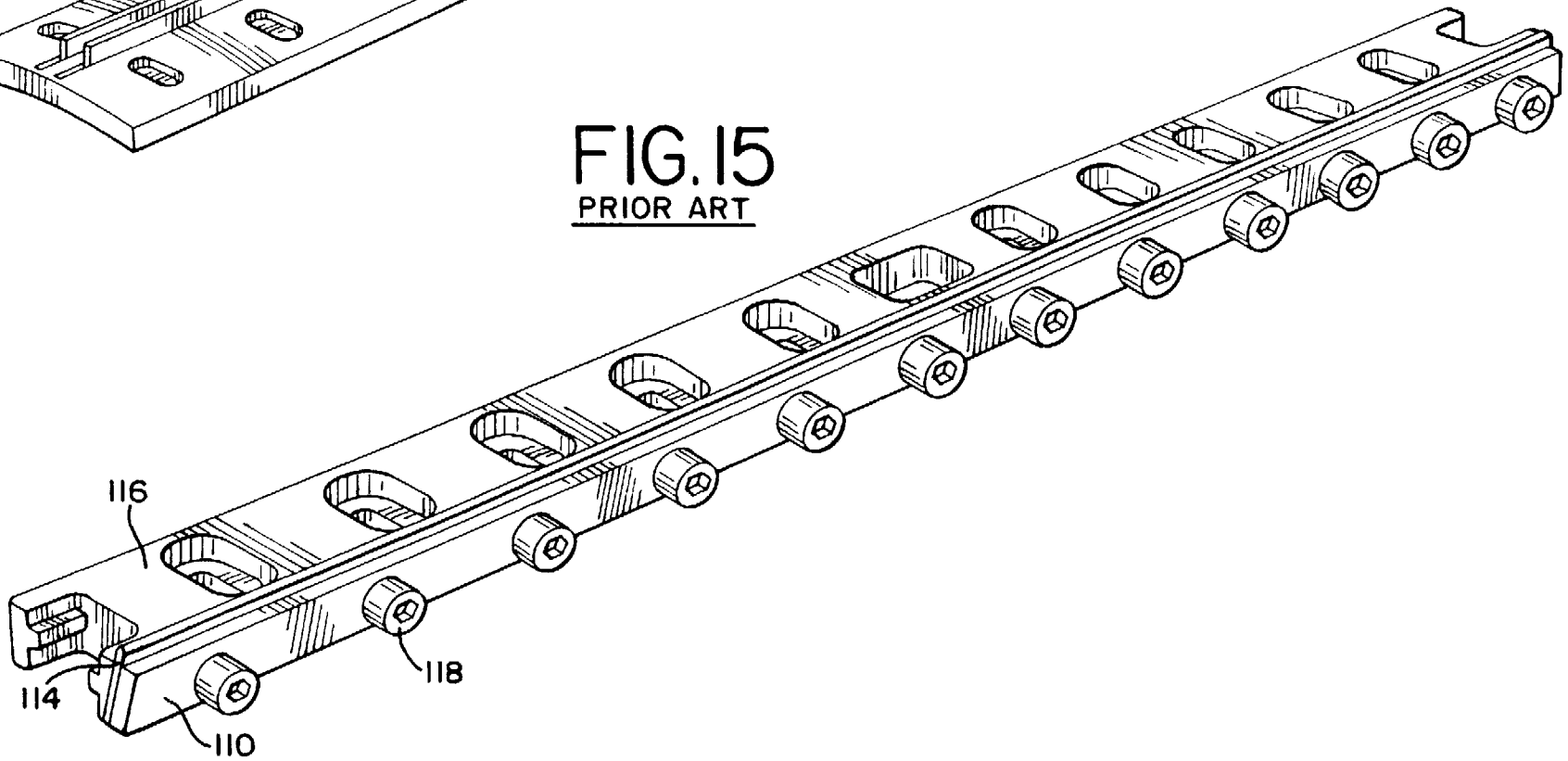
FIG. 15 PRIOR ART
FIG. 15 is a perspective area of an exiting knife holder assembly with side mounted screws.

Alternatively, urethane strips 120 with 3/16 inch thickness as shown in FIG. 13 may be inserted on either side of the knives 26, 49 to decrease the wear on the knife blade. The urethane strips preferably have openings formed therein to fit onto the shaft of the peg members 22–25, and are placed on both sides of the knife or knives.

It should be appreciated that the present invention may be preformed or configured as appropriate for the intended application. The embodiments described above are to be considered in all respects only as illustrative and not restrictive. The scope of the invention is indicated by the following claims rather than by the foregoing description. All changes which come within the mean and range of equivalency of the claims are to be embraced within their scope.

We claim:

1. A knife holder apparatus comprising:

a holder including a top portion, a first side portion, a first top portion opening formed through the top portion, and a first side portion opening formed through the first side portion;

a peg member extending through the first side portion opening; and an adjusting bar including a top portion, and an end portion, the end portion attached to the peg member, an opening formed in the top portion of the adjusting bar having a tapered sidewall, the opening of the adjusting bar aligned with the first top portion opening of the holder.

2. The apparatus of claim 1 further comprising a slot formed through the top portion of the holder to allow the holder to be fastened to a knife cylinder.

3. The apparatus of claim 1 further comprising a backing bar attached to the peg member.

4. The apparatus of claim 1 wherein the peg member is screwably attached to the end portion of the adjusting bar.

5. The apparatus of claim 1 further comprising a knife for inserting on to the peg member.

6. The apparatus of claim 5 wherein the knife includes a notch for fitting on to the peg member.

7. The apparatus of claim 6 wherein the peg member has a cap portion to retain the knife.

8. The apparatus of claim 1 further comprising a fastener for inserting through the top portion opening of the holder and contacting with the tapered sidewall of the adjusting bar.

9. The apparatus of claim 8 wherein the fastener comprises a set screw and the top portion opening of the holder has threaded sidewalls for receiving the set screw.

10. The apparatus of claim 9 wherein the opening formed through the top portion of the adjusting bar includes a tapered sidewall, and the set screw has a tapered portion which is at substantially the same angle as the tapered sidewall.

11. The apparatus of claim 1 further comprising a backing bar including an opening formed through the backing bar, the peg member extending through the backing bar opening, the peg member including a cap portion to retain the backing bar.

12. The apparatus of claim 1 wherein the top portion of the holder has a second top portion opening formed through the top portion of the holder at a position which is further than the first top portion opening of the holder from the first side portion.

13. The apparatus of claim 12 further comprising a first knife and second knife positioned on the peg member, and a spacer positioned between the first and second knife.

14. The apparatus of claim 13 further comprising a second opening formed in the top portion of the adjusting bar, the second opening of the top portion of the adjusting bar having a tapered sidewall.

15. The apparatus of claim 14 further comprising a set screw inserted through the second top portion opening of the holder and in contact with the second opening of the adjusting bar to clamp the first knife and second knife and spacer against the first side portion of the holder.

16. The apparatus of claim 1 wherein the holder includes a second side portion including an opening formed through the second side portion, the adjusting bar partially extending through the second side portion opening.

17. The apparatus of claim 1 further comprising a urethane strip positioned on the peg member.

18. A knife holder apparatus comprising:

a holder including a top portion and a top portion opening formed through the top portion;

a set screw screwably inserted in the top portion opening; and an adjusting bar including a top portion and an opening formed in the top portion having a tapered sidewall, the opening of the adjusting bar aligned with the top portion opening of the holder to allow the set screw to be inserted through the top portion opening of the holder and contact the tapered sidewall.

19. The apparatus of claim 18 wherein the set screw includes a tapered portion in contact with the tapered sidewall.

20. The apparatus of claim 19 wherein the tapered portion of the set screw and the tapered sidewall have substantially the same angle.

21. Apparatus for supporting a cutting knife disposed on a rotary die cutting machine comprising:

a holder including a top portion and first and second side portions, a first plurality of openings being formed through the top portion, a plurality of openings being formed through the first side portion, and a plurality of openings being formed through the second side portion;

a plurality of adjusting bars each slidably fitting through one of the second side portion openings and positioned within a cavity formed within said top portion and first and second side portions of said holder, each of the adjusting bars aligned with one of the top portion openings of the holder, the adjusting bars each including a first opening formed in the adjusting bars having a tapered sidewall;

a backing bar including a front and back side, a plurality of openings formed through the backing bar, each of the backing bar openings aligned with one of the adjusting bars;

a plurality of peg members each having a shaft portion and a cap portion, each of said shaft portions of the peg members slidably fitting through one of the backing bar openings and one of the second side portion openings, each of the shaft portions connected to one of the adjusting bars, the cap portions retaining the backing bar; and a plurality of fasteners movably fitted in the top portion openings of the holder for inserting through the top portion openings of the holder and contacting with the tapered sidewalls to move the adjusting bar toward the first side portion of the holder.

22. The apparatus of claim 21 further comprising a plurality of slots formed through the top portion of the holder.

23. The apparatus of claim 21 further comprising a second plurality of openings formed in the top portion of the holder and positioned closer than the first plurality of holder openings to the second side portion of the holder.

24. The apparatus of claim 23 further comprising a second opening formed in each of the adjusting bars, each of the second openings aligned with one of the second plurality of openings formed on the top portion of the holder.

25. The apparatus of claim 24 further comprising a space bar having a plurality of notches on the space bar to fit over the shaft portions of the peg members.

26. The apparatus of claim 21 further comprising at least one urethane strip clamped between the first side portion and the backing bar.

27. The apparatus of claim 21 wherein the fasteners comprise set screws each having an end portion with a taper to contact with the tapered sidewalls.

* * * * *